US005099861A

United States Patent [19]

Clearman et al.

[11] Patent Number: 5,099,861

[45] Date of Patent: Mar. 31, 1992

[54] AEROSOL DELIVERY ARTICLE

[75] Inventors: Jack F. Clearman, Blakely, Ga.; Joseph J. Chiou, Clemmons, N.C.; Darrell D. Williams, Winston-Salem, N.C.; William J. Casey, Clemmons, N.C.; Thomas L. Gentry; William C. Squires, both of Winston-Salem, N.C.

[73] Assignee: R. J. Reynolds Tobacco Company, Winston-Salem, N.C.

[21] Appl. No.: 486,025

[22] Filed: Feb. 27, 1990

[51] Int. Cl.[5] ..... A24D 1/18; A24B 15/16; A24B 15/18

[52] U.S. Cl. ..... 131/194; 131/195; 131/359; 131/360

[58] Field of Search ..... 131/194, 351, 352, 195, 131/369, 359

[56] References Cited

U.S. PATENT DOCUMENTS

| | | | |
|---|---|---|---|
| 2,907,686 | 10/1959 | Siegel . | |
| 3,258,015 | 6/1966 | Ellis et al. . | |
| 3,356,094 | 12/1967 | Ellis et al. . | |
| 3,516,417 | 6/1970 | Moses . | |
| 3,713,451 | 1/1973 | Bromberg . | |
| 4,219,032 | 8/1980 | Tabatznik et al. . | |
| 4,340,072 | 7/1982 | Bolt et al. . | |
| 4,347,855 | 9/1982 | Lanzillotti et al. . | |
| 4,474,191 | 10/1984 | Steiner . | |
| 4,596,258 | 6/1986 | Steiner . | |
| 4,708,151 | 11/1987 | Shelar . | |
| 4,714,082 | 12/1987 | Banerjee et al. . | |
| 4,732,168 | 3/1988 | Resce et al. . | |
| 4,756,318 | 7/1988 | Clearman et al. . | |
| 4,771,795 | 9/1988 | White et al. . | |
| 4,793,365 | 12/1988 | Sensabaugh, Jr. et al. . | |
| 4,819,665 | 4/1989 | Roberts et al. . | |
| 4,827,950 | 5/1989 | Banerjee et al. . | |
| 4,854,331 | 8/1989 | Banerjee et al. . | |
| 4,881,556 | 11/1989 | Clearman et al. . | |
| 4,969,476 | 11/1990 | Bale et al. | 131/194 |
| 5,060,676 | 10/1991 | Hearn et al. | 131/194 |

FOREIGN PATENT DOCUMENTS

| | | |
|---|---|---|
| 0117355 | 5/1984 | European Pat. Off. . |
| 0236992 | 9/1987 | European Pat. Off. . |
| 0271036 | 6/1988 | European Pat. Off. . |
| 0305788 | 3/1989 | European Pat. Off. . |
| 0352106 | 1/1990 | European Pat. Off. . |
| 0352108 | 1/1990 | European Pat. Off. . |
| 0352109 | 1/1990 | European Pat. Off. . |
| 0354661 | 2/1990 | European Pat. Off. . |
| 2057421 | 4/1971 | France . |
| 2057422 | 4/1971 | France . |

*Primary Examiner*—V. Millin

[57] ABSTRACT

An aerosol delivery article includes a longitudinally segmented combustible fuel element, and a substrate carrying flavor or a drug positioned physically separate from the fuel element. The fuel element is composed of a carbonaceous material and is extruded in such a manner that when positioned within the article, its extrusion axis is perpendicular to the longitudinal axis of the article. The fuel element is segmented longitudinally and includes a burning segment at one end, a base segment at the opposite end, and an isolation segment between the burning and base segments. A metal cartridge is radially spaced from the longitudinal outer periphery of the burning segment of the fuel element. A retaining member grasps the base segment of the fuel element and holds the fuel element securely in place within the article.

98 Claims, 4 Drawing Sheets

AEROSOL DELIVERY ARTICLE

BACKGROUND OF THE INVENTION

The present invention relates to aerosol delivery articles, and in particular, to those aerosol delivery articles having a heat source and a physically separate aerosol generating means. Such articles include a combustible fuel element, which upon use, is capable of producing heat which is transferred to the aerosol generating means for resultant aerosol production.

Over the years, there have been proposed numerous smoking products, flavor generators and medicinal inhalers which delivery volatile component to the mouth of the user. For example, numerous references have proposed articles which generate flavored vapor and/or visible aerosol. Most of such articles have employed a combustible fuel source to provide an aerosol and/or to heat an aerosol forming material. See, for example, the background art cited in U.S. Pat. No. 4,714,082 to Banerjee et al.

It would be desirable to provide an aerosol delivery article including a fuel element and a physically separate aerosol generating means; which article (i) is capable of providing substantial quantities of volatilized flavor and/or drug components, and (ii) makes efficient use of heat generated by the fuel element for aerosol formation.

SUMMARY OF THE INVENTION

The present invention relates to aerosol delivery articles which include a fuel element (i.e., a heat source) positioned in a heat exchange relationship with a physically separate aerosol generating means. In a highly preferred aerosol delivery article, the composition and configuration of the fuel element, as well as the positioning of the fuel element within the article, are such that very efficient use is made of the heat generated by that fuel element. As such, in a preferred article, a high proportion of the heat produced by a burning fuel element is exchanged to the aerosol generating means for aerosol generation.

In one aspect, a preferred aerosol delivery article of the present invention includes (i) an extruded combustible fuel element or heat source positioned within the article such that the extrusion axis of the fuel element is substantially perpendicular to the longitudinal axis of the aerosol delivery article; (ii) a physically separate aerosol generating means including at least one aerosol forming material; and (iii) means for securing, maintaining or retaining the fuel element within the article.

In another aspect, a preferred aerosol delivery article of the present invention includes (i) a longitudinally segmented combustible fuel element; (ii) a physically separate aerosol generating means including at least one aerosol forming material; (iii) means for securing, maintaining or retaining the fuel element within the article; and (iv) means for enclosing at least a portion of the longitudinal periphery of the fuel element so as to limit the amount of atmospheric oxygen which contacts the fuel element when the fuel element burns during use (i.e., an enclosure member). Typically, the enclosure member is capable of transferring heat from the burning fuel element to the aerosol generating means.

The aerosol delivery article includes a short, preferably carbonaceous, combustible fuel element or heat source. Typically, the fuel element is of a longitudinally segmented design such that only a portion of the length thereof is available for burning, and a portion of the length thereof serves as a base which allows the fuel element to be secured in place within the article. A preferred fuel element includes an isolation portion positioned between the burning and base portions thereof. A typical fuel element has a total length, prior to burning, of less than about 20 mm, and the length of the portion available for burning of less than about 15 mm. Preferred fuel elements are provided by subdividing a continuous extrudate into lengths, and employed such that the extrusion axis of the fuel element is substantially perpendicular to the longitudinal axis of the article into which the fuel element is incorporated.

The aerosol delivery article includes a retaining means for maintaining the fuel element in position therewithin. The retaining means contacts the fuel element and secures the fuel element in position within the article. In a preferred embodiment, a retaining member grasps the base of the fuel element, thereby serving to hold the fuel element securely in place.

The aerosol delivery article includes an aerosol generating means physically separate from, and longitudinally disposed from, the fuel element. The aerosol generating means includes a substrate and at least one aerosol forming material. The aerosol forming material generally is carried by a substrate, such as gathered paper, or a heat stable substrate (e.g., alumina beads).

The aerosol delivery article includes an enclosure member, which preferably is a heat conducting member for transferring heat generated by the burning portion of the fuel element to the aerosol generating means. As such, the conducting member is in a heat exchange relationship, and preferably is in a conductive heat exchange relationship, with the substrate which carries the aerosol forming material. The enclosure member is radially spaced from the longitudinal periphery of the fuel element. Normally, the enclosure member contacts (i) a portion of the aerosol generating means, and (ii) a portion of the retaining member. Preferably, the enclosure member is radially spaced from the longitudinal outer periphery of the fuel element, at least a portion of the length of the burning portion of the fuel element, and contacts the aerosol generating means. As such, the fuel element and the enclosure member define an airflow passageway, and air drawn through the passageway is heated.

The fuel element is thermally isolated from other portions or components of the aerosol delivery article. By this is meant that the burning portion of the fuel element experiences controlled heat loss (i.e., heat sinking), particularly as a result of conductive heat transfer, to other portions or components of the article. Thermal isolation of the fuel element is desirable, particularly during periods of smolder when the article is not being drawn upon, in order that the fuel element does not self-extinguish as a result of heat sinking to other portions of the article.

A preferred aerosol delivery article includes a mouthend piece for delivering aerosol to the mouth of the user. Typically, the mouthend piece has a generally tubular shape, and includes a filter element.

As used herein, the term "aerosol" is meant to include vapors, gases, particles, and the like, both visible and invisible, and even those components perceived by the user to be "smoke-like," formed by the action of heat generated by the fuel element upon materials contained within the aerosol generating means, or elsewhere in the aerosol delivery article.

As used herein, the term "carbonaceous" means comprising primarily carbon.

DETAILED DESCRIPTION OF THE PREFERRED EMBODIMENTS

Figure 1:
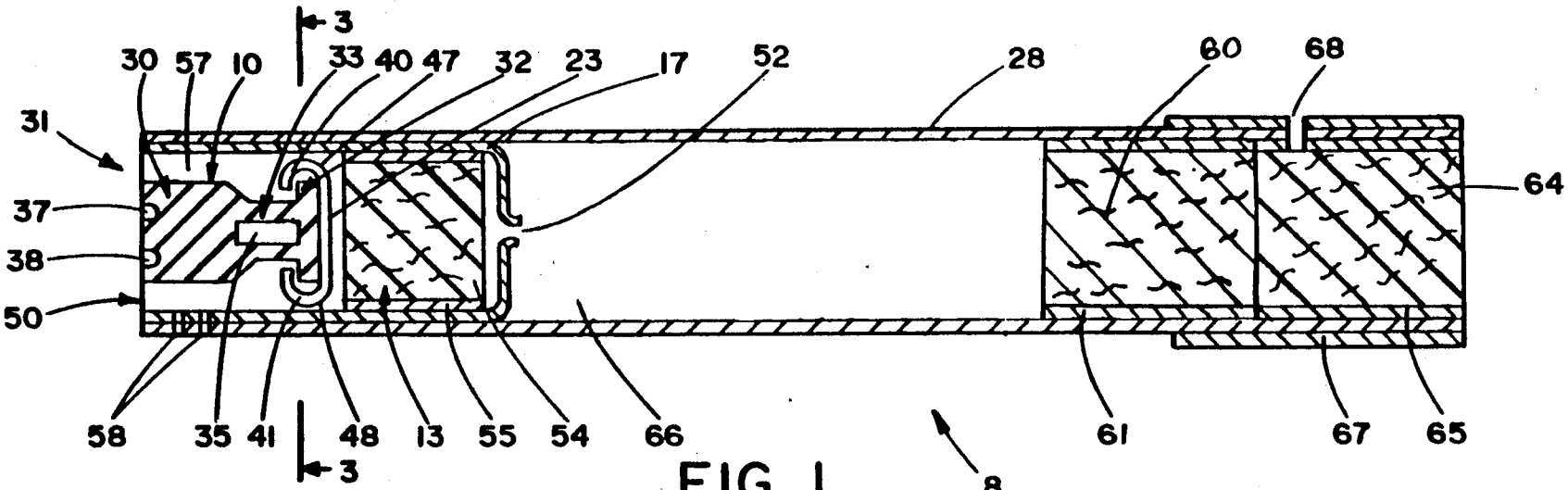
FIG. 1 is a longitudinal sectional view of an aerosol delivery article of the present invention.
Figure 2:
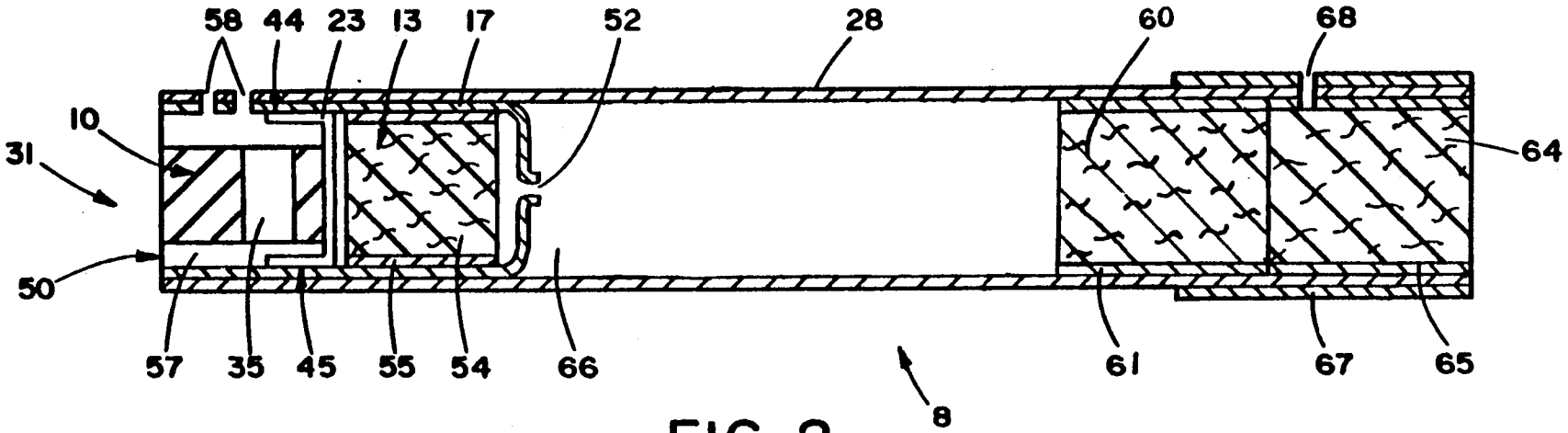
FIG. 2 is a longitudinal sectional view of the article illustrated in FIG. 1, but rotated 90° about the longitudinal axis of the article.

Referring to FIGS. 1 and 2, an embodiment of the present invention has the form of an aerosol delivery article 8. The article includes a heat source or fuel element 10; a substrate 13 which carries aerosol forming material and which is positioned behind the fuel element; an enclosure member 17 which contains the substrate and is radially spaced around the longitudinal periphery of the fuel element; a retaining member 23 which holds the fuel element securely in place within the article; and a tubular mouthend piece 28. A typical aerosol delivery article has a generally circular cross section and a circumference of about 20 mm to about 28 mm, and a length of about 70 mm to about 100 mm.

The heat source or fuel element 10, which preferably is an extruded carbonaceous material, has a generally square or rectangular cross sectional design. The preferred fuel element is a segmented fuel element which includes three longitudinally positioned portions or segments (as shown in FIG. 1); a burning portion 30 positioned near the extreme lighting end 31 of the article, a base or supporting portion 32 at the opposite end (i.e., mouth end) of the fuel element, and an isolation portion 33 positioned between the burning and base portions. The fuel element 10 is configured so that (i) the cross-sectional periphery of the base portion 32 is greater than the cross sectional periphery of the isolation portion, and (ii) the isolation portion includes at least one void space 35, which extends transversely through the fuel element. The void space acts to reduce the cross sectional area of the isolation portion, and as such, acts to minimize conduction of heat from the burning portion 30 to the base portion 33. In particular, void space 35 acts to assist in (i) providing separation of the burning and base segments, (ii) providing for a selected length over which the fuel element effectively burns, and (iii) minimizing conduction of heat from the burning portion of the fuel element through the base portion of the fuel element to other regions of the article. The fuel element 10 includes optional ribbed grooves 37, 38 extending across the foremost face of the burning portion thereof. The grooves 37, 38 aid in increasing the ease with which the fuel element is lighted. The burning and base portions of the fuel element do not have any longitudinally extending air passageways extending entirely therethrough.

Figure 3:
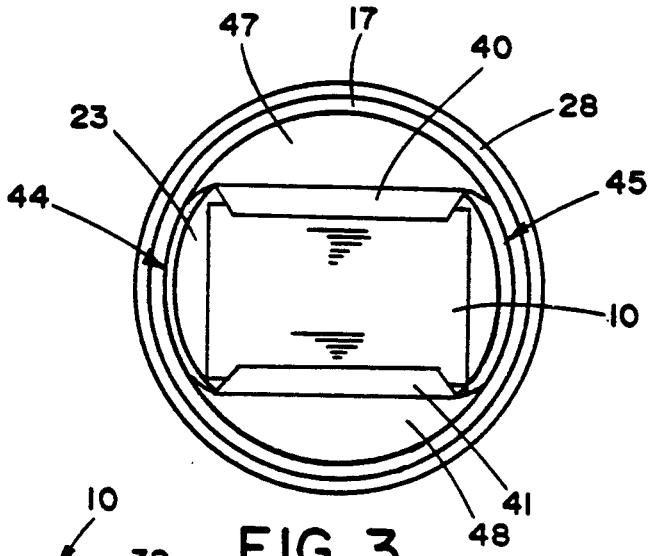
FIG. 3 is a cross sectional radial view of the article shown in FIG. 1 taken along lines 3—3 in FIG. 1.

Referring to FIGS. 1, 2 and 3, the heat source or fuel element 10 is held in place within the enclosure member 17 by a retaining member 23 including grasping portions 40, 41 (shown in FIGS. 1 and 3) which contact the base segment 32 of the fuel element. Preferably, the enclosure member is a heat conductive cartridge. A highly preferred retaining member 23 has cross sectional dimensions such that it (i) fits securely within the cartridge 17, preferably by friction fit, and (ii) contacts the cartridge at regions 44, 45 (shown in FIGS. 2 and 3) along the inner surface of the cartridge. The retaining member also provides airflow passages 47, 48 (shown in FIGS. 1 and 3) for passage of drawn air through the article. The retaining member is manufactured from a heat resistant material, such as a thin metal (e.g., aluminum) sheet.

Figure 4:
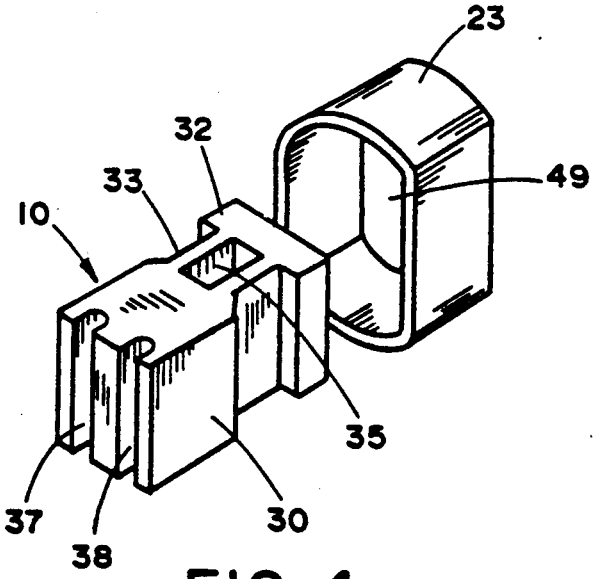
FIG. 4 is an exploded perspective of the unassembled fuel element and retaining member components of the article shown in FIGS. 1 and 2.

Referring to FIG. 4, fuel element 10, which is shown as longitudinally separated from a cup shaped retaining member 23, is inserted into the retaining member, preferably so that the base portion 32 of the fuel element abuts inner bottom face 49 of the retaining member. As shown in FIG. 4, the preferred retaining member has a generally oval cross sectional shape (i.e., two rounded sides and two flattened sides). The shape and dimensions of the retaining member can be selected so as to provide for the desired airflow passage through the article.

Figure 5:
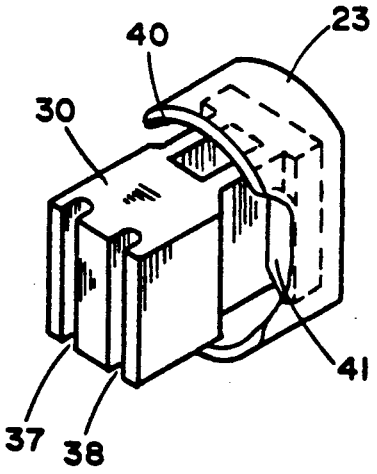
FIG. 5 is a perspective of the assembled fuel element and retaining member components of the article shown in FIGS. 1 and 2.

Referring to FIG. 5, when the fuel element 10 (shown partially in phantom) is inserted into the cup shaped retaining member 23, two portions of the retaining member are crimped inwardly so as to form grasping portions 40, 41 which extend over adjacent portions of the base segment of the fuel element.

Referring again to FIGS. 1 and 2, the substrate 13 is positioned within the cartridge 17 which includes (i) an open end 50 at one end (i.e., towards the extreme lighting end 31) of the article, and (ii) an opening 52 at the opposite end (i.e., toward the mouth end) of the article. The substrate is enclosed and maintained within the cartridge physically separate from the fuel element. The retaining member 23 also can extend over that portion of the fuel element 10 (i.e., the back face of the fuel element) which faces the substrate 13 in order to (i) provide further physical separation of the fuel element from the substrate, and (ii) hold the substrate in place within the cartridge. The preferred retaining member provides a barrier to airflow and migration of aerosol forming material between the fuel element and the substrate. The substrate can have various forms. One or more types of substrate material can be incorporated into a portion of the cartridge 17. For example, the substrate can include gathered paper 54 which carries glycerin and a flavor or a drug, is wrapped in a circumscribing paper wrapper 55, and is positioned adjacent the back face of the retaining member 23.

The cartridge 17 is manufactured from a heat resistant, thermally conductive material, such as a thin metal (e.g., aluminum) sheet. The cartridge is configured and positioned with respect to the fuel element 10 such that the cartridge (i) surrounds the longitudinal length of the fuel element, and (ii) is spaced apart from (e.g., not in direct contact with) the burning portion 30 of the fuel element. The burning portion of the fuel element can extend beyond the open end of the cartridge, be recessed from the open end of the cartridge, or extend so as to be flush with the open end of the cartridge (as shown in FIG. 1). The cartridge is open at the extreme lighting end of the article so as to expose completely the extreme lighting end of the fuel element.

The cartridge 17 is radially spaced from the longitudinal outer periphery of the fuel element, and as such, does not in any way contact the longitudinal periphery of the fuel element. In such a manner, an airflow passage 57 is formed between the longitudinal outer periphery of the fuel element and the heat conductive cartridge. In addition, the configuration is such that heat generated by the burning segment 30 of the fuel element tends to radiate radially to heat the portion of the cartridge which encloses (i.e., surrounds) that segment of the fuel element. The radial spacing of the heat conductive cartridge from the burning portion of the fuel element preferably is such that an amount of heat sufficient to heat the substrate and aerosol forming material carried thereby radiates from the burning fuel element to the cartridge. Typically, the cartridge has a length of about 8 mm to about 20 mm, and a circumference of about 20 mm to about 28 mm.

The cartridge 17 is positioned at one end of a tubular mouthend piece 28. The mouthend piece preferably is manufactured from metal foil-lined paper, insulative ceramic material, molded plastic, heavy weight paper, or the like. The mouthend piece 28 preferably has a configuration and dimensions such that the cartridge fits snugly therein and can be held in place by a friction fit. A portion of the mouthend piece can circumscribe or otherwise surround a portion of the length of the cartridge, or the total length of the cartridge (as illustrated in FIGS. 1 and 2). Optionally, a series of perforations 58 or other types of air inlet openings, are provided through the mouthend piece and cartridge in the region thereof which surrounds the burning portion 30 of the fuel element 10. The size, number and positioning of the perforations can be selected so as to provide a controlled oxygen supply to the burning portion of the fuel element during the period of use.

Within the tubular mouthend piece 28, behind the cartridge 17, is positioned a segment of gathered paper 60 wrapped in a circumscribing paper wrapper 61. Also within the mouthend piece, and positioned at the extreme mouthend of the article, is a low-efficiency filter element including a filter material 64 (e.g., a gathered web of non-woven polypropylene fibers) and a circumscribing plug wrap 65. The segment of gathered paper and the filter element, can be held in place within the mouthend piece by a snug friction fit or using adhesive. If desired, a void space 66 (e.g., filling a length of the mouthend piece of about 10 mm or more) can be provided between the back end of cartridge 17 and the gathered paper 60. Normally, tipping paper 67 circumscribes the extreme mouthend region of the article. Furthermore, a ring of air dilution perforations 68 optionally can be provided near the extreme mouthend region of the article using laser or mechanical perforation techniques.

In use, the user lights the heat source or fuel element 10 (e.g., using a lighter) and the burning portion 30 of the fuel element burns to produce heat. The heat generated by the fuel element radiates outwardly to heat the portion of the cartridge 17 which encloses or surrounds the fuel element, and the heat is in turn conducted through the cartridge to the portion thereof which contacts the substrate 13 and aerosol forming material carried thereby. In addition, some heat is conducted through the base of the fuel element, and through the retaining member, to the substrate and aerosol forming material carried thereby. During draw by the user, drawn air passes through the airflow passage 57 between the fuel element and cartridge, and is heated upon contact with the hot fuel element and the heated cartridge. The heated drawn air then passes through the airflow passages 47, 48 between the retaining member 23 and the cartridge, and contacts the substrate 13 which is in a heat exchange relationship with the burning fuel element. The resulting heat applied to the aerosol forming material acts to volatilize that material. The volatilized material within the warm drawn air exits the cartridge through opening 52. The drawn air and volatilized material then cools during passage through the mouthend piece. Depending upon the particular aerosol forming material, a visible aerosol then is formed. In particular, the drawn air and volatilized material passes through the gathered paper 60, through the filter material 64, and into the mouth of the user. As the base portion does not burn during the use of the article and the fuel element self-extinguishes after combustion of the burning portion is complete, the fuel element remains securely in the article during use and does not have a tendency to become dislodged from the article during use. When the fuel element self-extinguishes and no longer generates heat, the article is disposed of.

Figure 6:
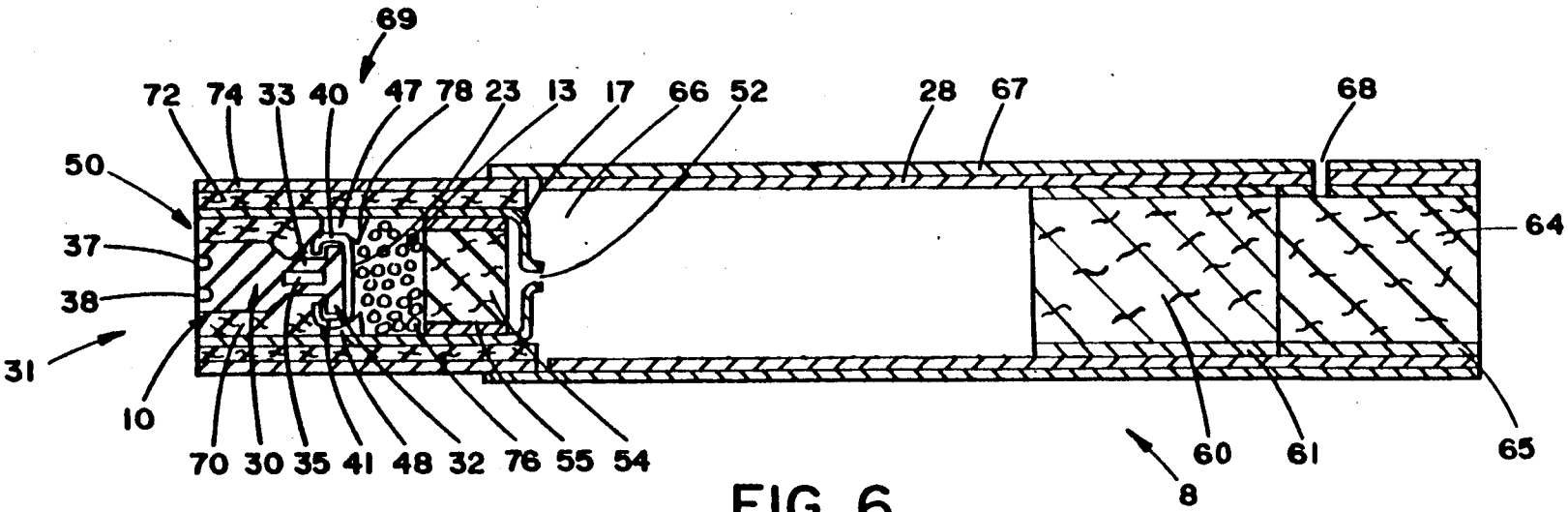
FIG. 6 is a longitudinal sectional view of an aerosol delivery article of the present invention.
Figure 7:
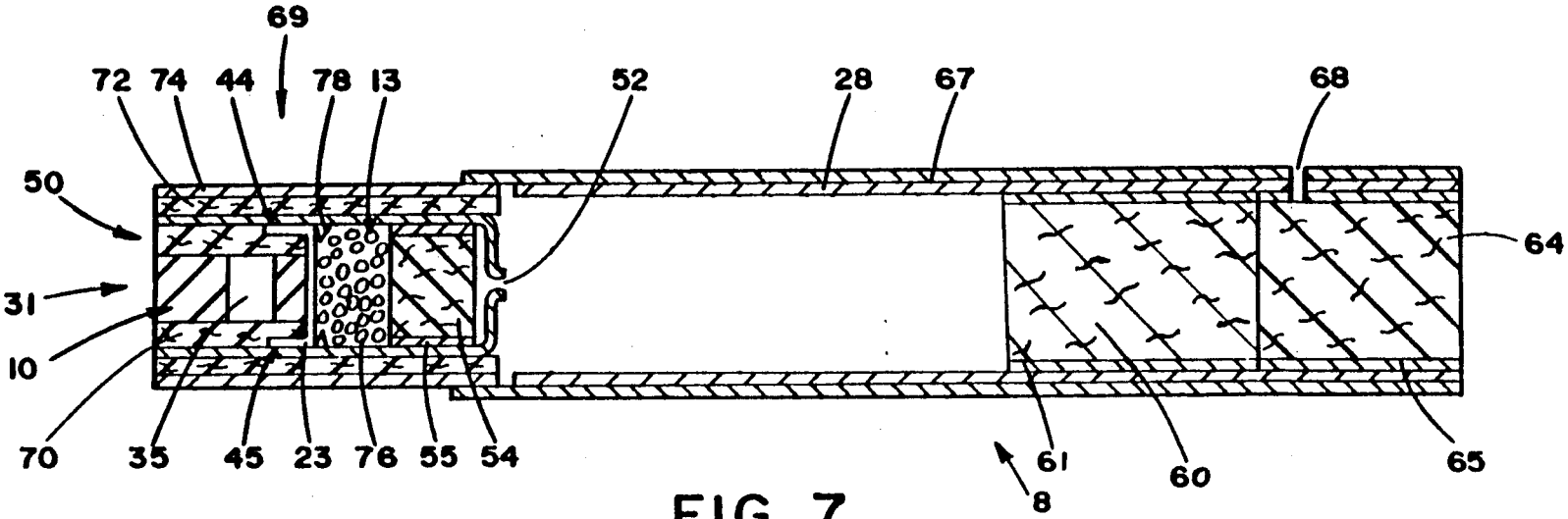
FIG. 7 is a longitudinal sectional view of the article illustrated in FIG. 6, but rotated 90° about the longitudinal axis of the article.

Referring to FIGS. 6 and 7, an alternate embodiment of the present invention has the form of an aerosol delivery article 8 which is similar in many respects to that article illustrated in FIGS. 1, 2 and 3. The article includes a front end assembly 69 including a fuel element 10; a substrate 13 which carries aerosol forming material; an enclosure member having the form of a heat conductive cartridge 17 which contains the substrate; and a retaining member which holds the fuel element in place within the article. The article also includes a separate tubular mouthend piece 28.

The fuel element 10, which preferably includes longitudinally positioned portions or segments, is circumscribed by an air permeable insulating material 70, such as glass fibers. Representative air permeable insulating materials are described in European Patent Application No. 339,690. The insulating material preferably (i) is such that drawn air can pass therethrough, (ii) is positioned and configured so as to assist in holding the fuel element in place, and (ii) has a character such that heat generated by the burning fuel element is transferred to the portion of the cartridge which is radially spaced from the fuel element.

The longitudinal outer periphery of the cartridge 17 is circumscribed by insulating material 72, such as insulating glass fibers. The insulating material 72 is such that heat generated by burning fuel element 10 and which is transferred to the cartridge 17, is used for efficiently heating the aerosol forming material of the aerosol generating means. The insulating material is circumscribed by an outer wrap 74, such as paper.

The cartridge 17 contains two types of substrate materials. In particular, the substrate includes (i) alumina beads 76, which carry glycerin and a flavor or a drug, and which are positioned adjacent the back face of the retaining member 23, and (ii) gathered paper 54 which carries glycerin and a flavor or a drug, which is wrapped in a circumscribing paper wrapper 55, and which is positioned behind the alumina beads. The cartridge can be crimped 78, or otherwise deformed to assist in securing the retaining member within the desired position within the article.

Tubular mouthend piece 28 is positioned in an abutting end-to-end relationship with the front end assembly 69. Preferably, the cross-sectional shape and dimensions of the mouthend piece are essentially identical to those of the front end assembly. The front end assembly 69 and separate mouthend piece 28 are attached to one another using a circumscribing tipping material 67.

Figure 8:
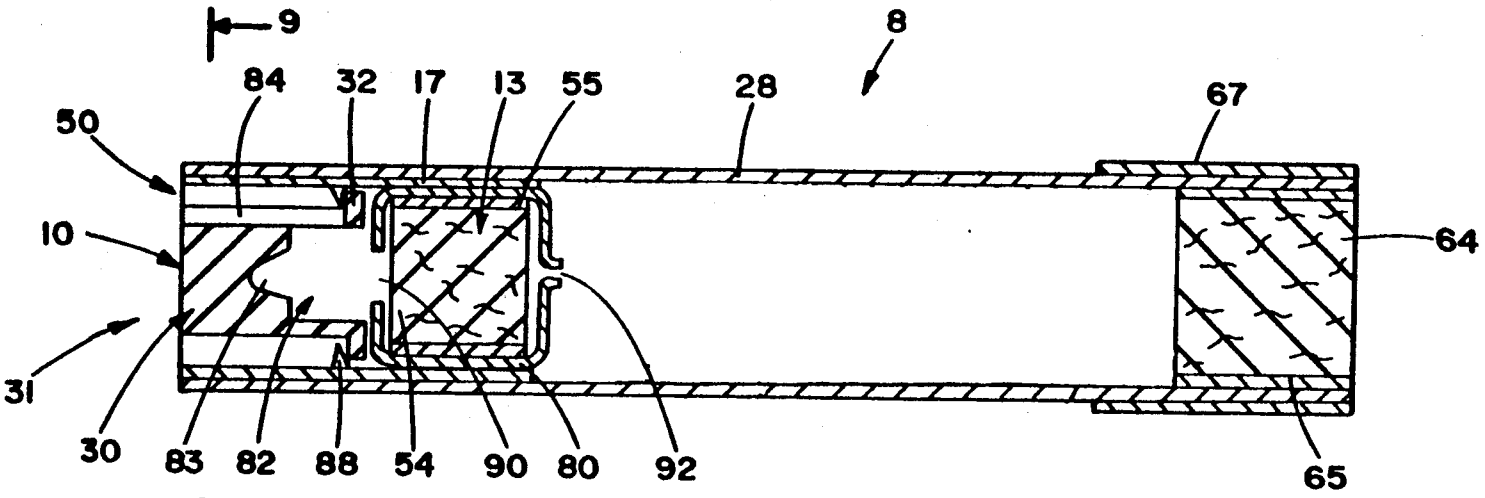
FIG. 8 is a longitudinal sectional view of a aerosol delivery article of the present invention.

Referring to FIG. 8, an alternate embodiment of the present invention has the form of a an aerosol delivery article 8 which is similar in many respects to the article illustrated in FIGS. 1 and 2. The article includes a fuel element 10; a substrate 13 which carries aerosol forming material; a tubular heat conductive enclosure member 17 into which the fuel element is positioned; a heat conductive cartridge 80 positioned behind the fuel element and within the enclosure member, and containing the substrate; and a tubular mouthend piece 28.

The fuel element 10 has a generally circular radial cross sectional shape, and includes a base portion 32 and a burning portion 30. The circumference of the base portion 32 is greater than that of the burning portion 30. The preferred fuel element 10 is compression molded so as to have a hollow region 82 extending from the base portion towards the burning portion. Optionally, a series of air passageways (not shown) can extend longitudinally through the fuel element. Optionally, at least one hollow region 83 can extend into the burning portion of the fuel element, so that when the element burns back during use there can form at least one airflow passageway through the fuel element. The fuel element includes at least one groove or channel 84 extending longitudinally along the outer periphery of the burning portion toward the base portion such that the channel and the hollow region 82 connect. In such a manner, drawn air passes through channel 84, into hollow region 82, and then through the aerosol generating means.

Figure 9:
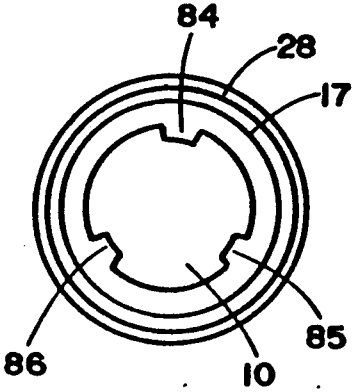
FIG. 9 is a cross sectional radial view of the article shown in FIG. 8 taken along lines 9—9 in FIG. 8.

Referring to FIG. 9, the burning portion of fuel element 10 includes grooves 84, 85 and 86 extending along the outer longitudinal periphery thereof. Other configurations of grooves (e.g., 4 pairs of grooves spaced at 90° intervals) can be employed.

The fuel element 10 is inserted through the back of the enclosure member 17 such that the base portion 32 abuts inwardly extending lip or crimp 88. Then, the substrate 13 is positioned within cartridge 80, and the ends of that cartridge are crimped inwardly so as to enclose the substrate while maintaining inlet opening 90 and outlet opening 92 at each end of the cartridge. The cartridge then is inserted into the back of the enclosure member to abut the back of the base portion of the fuel element. Preferably, the inner dimensions of the enclosure member 17 and the outer dimensions of the cartridge 80 are such that the cartridge is secured firmly in place by a friction fit. As such, the front portion of the cartridge 80 and the crimp 88 in the enclosure member 17 provide a retaining means for holding the fuel element 10 securely in place within the article.

FIGS. 10 through 15 illustrate representative configurations of heat sources or fuel elements which can be incorporated into aerosol delivery articles of the present invention, and particularly into those articles previously described with reference to FIGS. 1 through 7.

Figure 10:
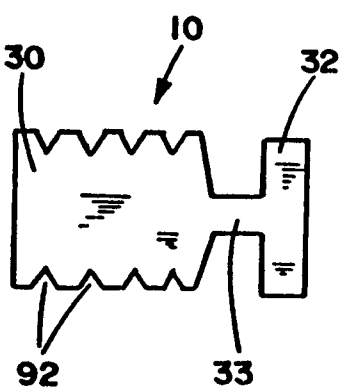

Referring to FIG. 10, fuel element 10 includes a burning portion 30, an isolation portion 33 and a base portion 32. The isolation portion has cross sectional outer dimensions which are significantly less than that of the base portion. In addition, the fuel element includes a plurality of notches 92 spaced longitudinally along the length of the burning portion, add extending transversely across the fuel element.

Figure 11:
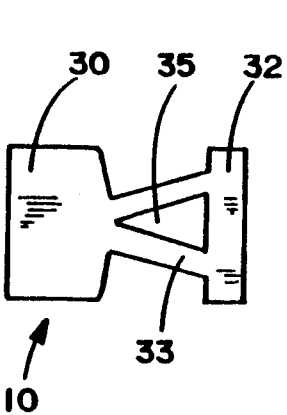

Referring to FIG. 11, fuel element 10 includes a void space 35 extending transversely through the fuel element. The void space has a generally triangular shape, having a base essentially parallel to the back face of the fuel element and a tip which extends to the burning portion of the fuel element.

Figure 12:
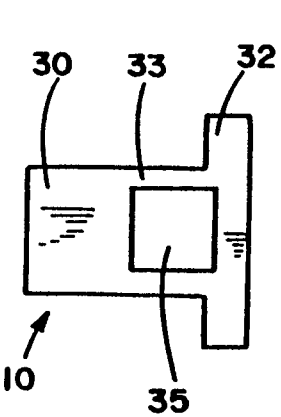

Referring to FIG. 12, fuel element 10 includes burning segment 30 and isolation segment 33 having identical cross sectional outer dimensions and base segment 32 having a cross sectional periphery which is greater than that of the burning and isolation segments. The fuel element includes a void space 35 extending transversely through the isolation segment and a portion of the length of the base segment.

Figure 13:
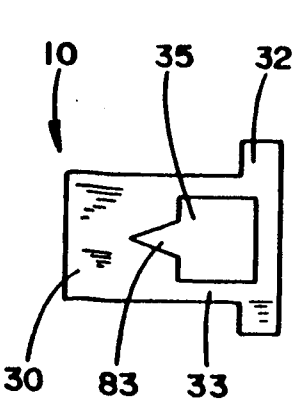

Referring to FIG. 13, fuel element 10 includes a void space 35 extending transversely through the isolation portion 33, and a further void space 83 extending transversely through a portion of the length of the burning portion. As such, when the burning portion of the fuel element burns back during use, a longitudinally extending passageway is formed through a portion of the fuel element. Thus, after a certain period during use within an aerosol delivery article, drawn air can pass through the burning fuel element (i.e., and hence be heated), and then pass to the aerosol generating means. The ability to have drawn air pass through the burning portion of the fuel element provides for increased heat transfer to the aerosol generating means for aerosol formation during later stages of use of the article. As such, it is possible to provide a fuel element capable of providing a relatively consistent transfer of heat to the aerosol generating means over the useful life of the fuel element.

Figure 14:
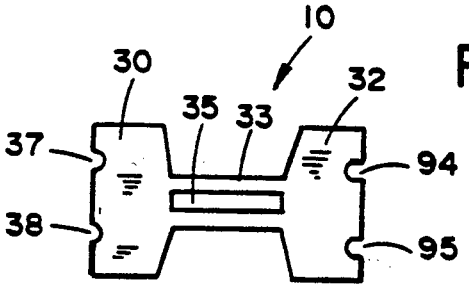
FIGS. 10 through 15 are longitudinal views of representative fuel elements for aerosol delivery articles of the present invention.

Referring to FIG. 14, fuel element 10 includes a burning segment 30, a base segment 32, and isolation segment 33 including a void space 35 extending transversely therethrough. The burning and base segments are similarly shaped, and as such, each end can be employed as a burning or base segment, depending upon the manner in which the fuel element is positioned within the article. The fuel element also can include ribbed grooves 37, 38 extending across the foremost face of the burning segment, and ribbed grooves 94, 95 extending across the back face of the base segment.

Figure 15:
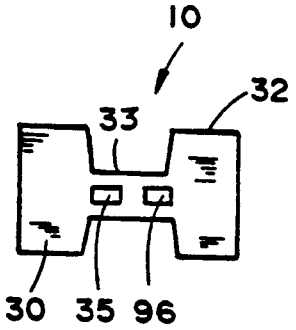

Referring to FIG. 15, fuel element 10 is similar to the fuel element described with reference to FIG. 14, except that two void spaces 35, 96 extend transversely through the isolation segment 33.

An aerosol delivery article of the present invention includes an aerosol generating means which is physically separate from the fuel element. As such, the aerosol generating means is not mixed with, or is not part of, the fuel element. The aerosol generating means is in a heat exchange relationship with the fuel element in order that heat generated by the burning fuel element is transferred to the aerosol generating means for heating and volatilizing the aerosol forming material.

The preferred aerosol generating means includes a substrate for carrying the aerosol forming material. Preferred substrates retain the aerosol forming material when not in use, and release the aerosol forming material during use.

One type of substrate has the form of a non-woven sheet-like material or a cellulosic material, such as paper. Such a substrate typically is provided as a cylindrical segment including a gathered web of paper within a circumscribing outer wrapper. Such cylindrical segments can be provided from rods which are manufactured using equipment and techniques described in U.S. Pat. No. 4,807,809 to Pryor et al. Exemplary papers which are gathered to form substrates are available as MS2408/S538 from Filtrona, Ltd. Another substrate can have the form or a porous, air permeable pad which wicks liquid aerosol forming material from a container.

Another type of substrate material is a thermally stable material (e.g., a material capable of withstanding temperatures of about 400° C. to about 600° C. without decomposing or burning). Examples of such materials include porous grade carbons, graphite, carbon yarns, activated and non-activated carbons, and ceramics. Suitable carbon substrate materials include PC-25 and PG-60 available from Union Carbide Corp., SGL available from Calgon Carbon Corp., and Catalog Nos. CFY-0204-1, CN-157(HC), CN-210(HC), ACN-211-10 and ACN-157-10 from American Kynol Inc. Other suitable substrate materials include alpha alumina beads available as D-2 Sintered Alpha Alumina from W. R. Grace & Co., as well as those substrate materials described in U.S. Pat. No. 4,827,950 to Banerjee et al. If desired, the substrate material can be a porous, air permeable extruded material.

Another type of substrate has the form of a densified pellet formed from carbon or mixtures of alumina and cellulose. Densified pellets can be manufactured using a Marumerizer available from Fuji Paudal KK, Japan. See, German Patent No. 1,294,351, U.S. Pat. No. Re 27,214 and Japanese Patent Specification No. 8684/1967.

More than one type of substrate material can be employed in providing the aerosol generating means. For example, alumina beads which carry aerosol forming material can be positioned behind the fuel element, and a cylindrical segment of gathered paper carrying aerosol forming material can be positioned behind the alumina beads.

The aerosol generating means includes aerosol forming material, and the aerosol forming material is in a heat exchange relationship with the fuel element. The aerosol forming material can have a liquid, semi-solid or solid form, and generally is carried by a substrate. Examples of preferred aerosol forming materials include the polyhydric alcohols (e.g., glycerin, propylene glycol and triethylene glycol), the aliphatic esters of mono-, di-, or poly-carboxylic acids (e.g., methyl stearate, dimethyl dodecandioate and dimethyl tetra decanedioate), and the like. Examples of other aerosol forming materials include volatile flavors, and drugs. Combinations of various aerosol forming materials can be employed The flavors useful herein are those which are capable of being delivered to the user in aerosol form. Such flavors include menthol, peppermint, spearmint, cinnamon, vanilla, licorice, ginger, mouth fresheners, chocolate, coffee and coffee flavors, liqueurs, root beer, spice, nut, pepper, pizza, bacon, sausage, cereal, popcorn, cookie, strawberry, citrus, raspberry, cherry, and the like.

Drugs useful herein are those which can be administered in an aerosol form directly into the respiratory system of the user. As used herein, the term "drug" includes articles and substances intended for use in the diagnosis, cure, mitigation, treatment or prevention of disease; and other substances and articles referred to in 21 USC 321(g)(1). Typical of such drugs are those which are used in the treatment of asthma, emphysema, bronchitis, epilepsy, shock, hypertension, cardiac arrhythmia, sinus congestion, allergies, convulsions, anxiety, schizophrenia, and the like. Examples of suitable drugs include ephedrine, metaproterenol, terbutaline, dopamine, phenytoin, diazepam, propranolol, diphenhydramine, and the like.

The amount of aerosol forming material which is employed can vary, depending upon factors such as the particular substrate which is employed or the particular composition of the aerosol forming material. Generally, the amount of aerosol forming material employed per aerosol delivery article ranges from about 20 mg to about 200 mg, preferably about 35 mg to about 150 mg. For each particular article, the amount of flavor can vary, depending upon the taste desired; and the amount of drug can vary, depending upon the particular drug and the particular dose required.

Although an individual drug can be employed to form an aerosol with or without another aforementioned aerosol forming material (e.g., glycerin), it is desirable to employ such other aerosol forming material with a drug in order that an identifiable, visible aerosol is provided during use of the aerosol delivery article. As such, the user readily can identify when a dose of the drug is complete.

The aerosol delivery article of the present invention includes a heat source which generates heat sufficient to volatilize aerosol forming material within the aerosol generating means. A preferred heat source or fuel element is manufactured from a combustible material in such a way that the density of the fuel element is greater than about 0.5 g/cc, frequently about 0.7 g/cc or more, often about 1 g/cc or more, sometimes about 1.5 g/cc or more, but typically less than about 2 g/cc. Additionally, the fuel element generally has a length, prior to burning, of less than about 20 mm, often less than about 15 mm, and frequently less than about 10 mm.

A highly preferred fuel element has a segmented design. Such a fuel element is designed in order that during use of the article into which the fuel element is incorporated (i) a portion of the length of the fuel element is available for burning, and (ii) a remaining longitudinal portion of the fuel element does not burn. The portion of the fuel element which is designed not to burn can be provided with such a characteristic as a result of factors such as (i) the selection of the composition of that portion of the fuel element, (ii) the overall shape or configuration of the fuel element, (iii) the location of the fuel element within the article, and (iv) the manner in which the fuel element is secured within the article. The preferred segmented fuel element includes (i) a burning portion for heat generation, (ii) a non-burning portion including a base or support portion, and (iii) an isolation portion positioned between the burning and base portions. A preferred segmented fuel element also is designed and configured so that heat does not transfer readily from the burning portion of the fuel element to the non-burning portion of the fuel element. As such, conductive transfer of heat from the fuel element to other regions of the article is controlled, and preferably is minimized, in order that the burning fuel element does not exhibit a propensity to self-extinguish over normal smolder periods. Normally, the length of the burning portion of the fuel element is about 2 mm to about 15 mm, preferably about 4 mm to about 8 mm, prior to burning. Normally, the length of the base portion of the fuel element is about 1 mm to about 3 mm. Normally, the length of the isolation portion of the fuel element is up to about 5 mm.

A preferred fuel element has a radial or transverse cross section such that two opposite sides thereof are essentially parallel to one another. Also, preferred segmented fuel elements are such that the transverse cross sectional shape of each segment, and particularly the base segment, is generally square, rectangular or parallelepiped (i.e., each segment of the fuel element has four sides extending along the length of the fuel element, and each pair of opposite sides are essentially parallel to one another).

The maximum cross sectional dimensions of the fuel element can vary, but are such that the burning portion of the fuel element does not contact the enclosure member which surrounds that portion of the fuel element. Typically, the burning portion of the fuel element is positioned about 0.2 mm to about 2 mm, but preferably at least about 1 mm, from the enclosure member. A typical burning portion of a fuel element has a cross sectional area of about 10 $mm^2$ to about 25 $mm^2$. A typical base portion of a fuel element has a cross sectional area of about 15 $mm^2$ to about 30 $mm^2$. Although it is desirable that the cross sectional dimensions of the isolation portion of the fuel element be as small as possible, a typical isolation portion has a cross sectional area of about 5 $mm^2$ to about 10 $mm^2$.

The composition of the combustible material of the fuel element can vary. Preferred fuel elements contain carbon, and highly preferred fuel elements are composed of carbonaceous materials. Preferred carbonaceous materials have a carbon content above about 60 weight percent, more preferably above about 75 weight percent. Flavors, extracts, fillers (e.g. clays or calcium carbonate), burn additives (e.g., sodium chloride to improve smoldering and act as a glow retardant), combustion modifying agents (e.g., potassium carbonate to control flammability), binders, and the like, can be incorporated into the fuel element. Exemplary compositions of preferred carbonaceous fuel elements are set forth in U.S. Pat. Nos. 4,793,365 to Sensabaugh, Jr. et al, 4,756,318 to Clearman et al and 4,881,556 to Clearman et al, and U.S. patent application Ser. No. 378,551, filed July 11, 1989, now U.S. Pat. No. 4,991,596 to Lawrence et al; as well as in European Patent Application No. 236,992. Other fuel elements can be provided from cellulosic materials, modified cellulosic materials, and the like.

Fuel elements for articles of the present invention advantageously are molded, machined, pressure formed or extruded into the desired shape. Molded fuel elements can have passageways, grooves or hollow regions therein. Preferred extruded carbonaceous fuel elements can be prepared by admixing up to 95 parts carbonaceous material and up to 20 parts binding agent with sufficient water to provide a paste having a stiff dough-like consistency. The paste then can be extruded using a ram, screw or piston type extruder into an extrudate of the desired shape having the desired number of passageways or void spaces. The extrudate can be passed through a pair of spiked or grooved rollers in order to imprint grooves (either transversely or longitudinally to the extrusion axis of the extrudate) at regular intervals, so as to provide a particular surface character to selected surfaces of the ultimate fuel element. The extrudate then can be dried to a low moisture content, typically between about 2 and about 7 weight percent. Then, a continuous length of extrudate is cut or otherwise subdivided at regular intervals, to provide a plurality of individual fuel elements. As such, it is possible to provide a fuel element having an extrusion axis which is perpendicular (i.e., rather than parallel) to the longitudinal axis of the aerosol delivery article into which the fuel element is ultimately incorporated. If desired, various types of materials can be co-extruded to provide fuel elements having burning portions and base portions which are of different compositions. For example, (i) the base and isolation portions of the fuel element can be composed of a material having a combustion propensity less than that material which is used to provide the burning portion of the fuel element, or (ii) the extreme lighting end of the fuel element can be composed of a material having an extremely high combustion propensity so as to increase the ease with which the fuel element is lighted.

The enclosure member is manufactured from a heat resistant material. The enclosure member preferably is a heat conducting member, and normally is composed of a metallic sheet strip or foil. Typically, the thickness of the conducting member ranges from about 0.01 mm to about 0.2 mm. The thickness, shape and/or type of material used to manufacture the heat conducting member can vary, in order to provide the desired degree of heat transfer to the aerosol forming material. A preferred heat conducting member is manufactured from thin aluminum sheet. The heat conducting member (i) can have a one piece construction or be manufactured from two or more segments, or (ii) be manufactured from one or more heat conductive materials.

The heat conducting member preferably extends over at least a portion of the length of the burning portion of the fuel element, and forms a container which encloses the aerosol forming material. The heat conducting member is radially spaced from a significant portion of the length of the burning portion of the fuel element, and can extend beyond the foremost lighting end of the fuel element. In the most highly preferred embodiments, the heat conducting member is spaced apart from the burning portion of the fuel element as well as the isolation and base portions of the fuel element (i.e., the fuel element is physically isolated from the heat conducting member). As such, conductive heat transfer from the fuel element to the heat conductive member (and hence to the aerosol generating means) is controlled and preferably is minimized.

Preferably, the fuel element is positioned within the aerosol delivery article so that the burning portion of the fuel element is thermally isolated from heat sinking components of the article. Furthermore, the fuel element is positioned within the article so that the fuel element experiences a limited or regulated oxygen supply during the burning period. As such, it is highly preferable to employ small, low mass fuel elements which heat up quickly, burn sufficiently to maintain an operating temperature (and hence not self-extinguish), and produce heat sufficient for aerosol formation during the period when the article is drawn upon. The radial spacing between the burning portion of the fuel element and the heat conducting member is close enough so that heat generated by the burning fuel element transfers radiantly to the heat conducting member. However, the radial spacing between the burning portion of the fuel element and the heat conducting member is such that the burning portion receives a sufficient supply of oxygen for the fuel element to sustain smolder during the period of normal use of the article. In addition, the fuel element and heat conducting member preferably are arranged such that drawn air passing through an airflow passage between the fuel element and the heat conducting member is heated thereby providing convective heating of the aerosol generating means. The spacing or configuration of the fuel element and heat conducting member can be selected in order to provide for the desired amount of convective heat transfer. Alternatively, the drawn air can pass through an airflow passage formed within the heat conducting member, such that the drawn air is heated as it passes through that passage to the aerosol generating means. If desired, the heat conducting member can be configured so that drawn air experiences a tortuous path prior to and/or during contact with the aerosol forming material.

The retaining means can vary in shape and composition. However, the retaining means most preferably is manufactured from a thin metal sheet which can be easily deformed so as to (i) hold the fuel element securely in place, and (ii) remain in position within the article. In the preferred embodiments, a retaining member acts as a physical barrier between the fuel element and the aerosol forming material within the aerosol generating means. In the most highly preferred embodiments, the retaining means provides an air impermeable barrier between the back face of the fuel element and the aerosol generating means. As such, migration of aerosol forming material to the fuel element is minimized. In the preferred embodiments, a controlled spacing between one or more regions between the retaining member and the heat conducting member permits drawn air to be drawn across the fuel and into the aerosol generating means (i.e., at least one air passageway is provided). If desired, passageways or slits can be formed in the back face of the retaining member for airflow passage, or the retaining member can be deformed or slit to provide for a secure holding of the fuel element as well as for adequate airflow passage.

Although much less preferred, the retaining means can be manufactured from a series of wires or wire mesh. The wire can be formed to grasp the base of the fuel element as well as hold the fuel element in place within the article. The selection of the particular wire, as well as the selected configuration of the wire so that the fuel element is held securely in place within the article, will be apparent to the skilled artisan. One end of the wire can be molded into the fuel element, and the opposite end of the wire can be used to secure the fuel element in place within the article. If desired, a series of wires can extend through and/or around the fuel element to secure the fuel element in place. Alternatively, a series of wires can pass through a combustion-resistant portion of a co-extruded fuel element in order to hold the fuel element securely in place. Such co-extruded fuel elements include a combustible portion for heat generation and a combustion-resistant portion, extending either transversely across or longitudinally through the fuel element, through which the wire retaining means extends. As such, it is possible to maintain the fuel element within the article, both prior to use and while the fuel element is burned during use. Typically, fuel elements are extruded with passageways extending therethrough in order that the wires which make up the retaining member conveniently can be passed through the fuel element in order to hold the fuel element in place. Retaining members manufactured from thin metal wires or wire mesh provide for good thermal isolation of the fuel element because thin wires tend not to conduct large amounts of heat very effectively to other components of the article. An article having a wire or wire mesh retaining member optionally can be provided with a perforated end cap which extends over the foremost lighting end of the article.

In most embodiments of the present invention, the heat conductive cartridge which contains the substrate and the aerosol forming material is attached to the mouthend piece; although a disposable fuel element and cartridge can be employed with a separate, reusable mouthend piece. The mouthend piece provides a passageway which channels vaporized aerosol forming materials into the mouth of the user; and can also provide a source of flavor to the vaporized aerosol forming materials. Typically, the length of the mouthend piece ranges from 40 mm to about 85 mm. Typically, the length of the mouthend piece is such that (i) the burning portion of the fuel element and the hot heat conducting member are kept away from the mouth and fingers of the user; and (ii) hot vaporized aerosol forming materials have sufficient time to cool before reaching the mouth of the user. Oftentimes, it is highly desirable to provide a void space within the mouthend piece immediately behind the aerosol generating means. For example, a void space extending at least along the length of the article about 10 mm is provided immediately behind the aerosol generating means and forward of any paper or filter segments.

Suitable mouthend pieces normally are inert with respect to the aerosol forming material, offer minimum aerosol loss as a result of condensation or filtration, and are capable of withstanding the temperatures experienced during use of the article. Exemplary mouthend pieces include plasticized cellulose acetate tubes, such as is available as SCS-1 from American Filtrona Corp.; polyimide tubes available as Kapton from E. I. duPont de Nemours; paperboard or heavy paper tubes; and aluminum foil-lined paper tubes.

The entire length of the article, or any portion thereof, can be overwrapped with paper. Preferred papers which circumscribe the heat conducting member should not openly flame during use of the article and should have controllable smolder properties. Exemplary, papers are described in U.S. Pat. No. 4,779,631 to Durocher et al and European Patent Application No. 304,766. Suitable paper wrappers are available as P1981-152, P1981-124 and P1224-63 from Kimberly-Clark Corp. Tipping paper can circumscribe the extreme mouth end of the article. Suitable tipping papers are non-porous tipping papers treated with "non-lipsticking" materials, and such papers will be apparent to the skilled artisan.

A segment of gathered paper can be incorporated into the mouthend piece. Such a segment can be positioned directly behind the heat conducting member which contains the aerosol forming material, and can carry a flavor which can be eluted by aerosol particles passing through the mouthend piece. A segment of gathered carbon paper can be incorporated into the mouthend piece, particularly in order to introduce menthol flavor to the aerosol. Suitable gathered carbon paper segments are described in European Patent Application No. 342,538.

The extreme mouthend of the aerosol delivery article preferably includes a filter element or tip, particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials, or gathered webs or nonwoven polypropylene materials. Suitable filter elements can be provided by gathering a non-woven polypropylene web available as PP-100-F from Kimberly-Clark Corp. using the filter rod forming apparatus described in Example 1 of U.S. Pat. No. 4,807,809 to Pryor et al.

Aerosol delivery articles of the present invention are capable of providing at least about 6 to about 10 puffs, when used under conditions of a 35 ml puff volume of 2 seconds duration, separated by 58 seconds of smolder. A typical fuel element of a preferred article of the present invention provides less than about 300 calories, preferably between about 200 and about 250 calories, when the article is used under the previously described conditions. During the period that the preferred article is used, at least about 65 percent, preferably at least about 75 percent of the heat produced by the burning fuel element is used for heating the aerosol generating means and for the consequential generation of aerosol for mainstream aerosol delivery.

Preferred combustible fuel elements generate temperatures of about 400° C. to about 700° C. Due to the relatively low temperatures and relatively low amounts of heat generated by the preferred fuel elements, typical articles incorporating such fuel elements yield less than about 10 mg, preferably less than about 5 mg, and most preferably less than about 2 mg of carbon monoxide, when used under the previously described conditions.

Preferred aerosol delivery articles of the present invention are capable of yielding at least about 0.6 mg of aerosol, measured as wet total particulate matter (WTPM), in the first 3 puffs, when used under the previously described conditions. Moreover, preferred articles yield an average of at least about 0.2 mg of WTPM per puff, for at least about 6 puffs, preferably at least about 10 puffs, when used under the previously described conditions. Highly preferred articles yield at least about 5 mg of WTPM over at least 10 puffs, when used under the previously described conditions.

The aerosol produced by the preferred aerosol delivery articles of the present invention is chemically simple, consisting essentially of air, water, oxides of carbon, the aerosol former, any desired flavors or other desired volatile materials, and trace amounts of other materials.

The WTPM produced by certain preferred articles of the present invention has little or no measurable mutagenic activity as measured by the Ames test, (i.e., there is little or no significant dose response relationship between the WTPM produced by preferred articles of the present invention and the number of revertants occurring in standard test microorganisms exposed to such products). According to the proponents of the Ames test, a significant dose dependent response indicates the presence of mutagenic materials in the products tested. See Ames et al., *Mut. Res.*, 31: 347–364 (1975); Nagao et al., *Mut. Res.*, 42: 335 (1977).

The following examples are provided in order to further illustrate various embodiments of the invention, but should not be construed as limiting the scope thereof. Unless otherwise noted, all parts and percentages are by weight.

EXAMPLE 1

Aerosol delivery articles of the type illustrated in FIG. 1 are manufactured in the following manner:

Fuel Element Preparation

A segmented fuel element has base, isolation and burning portions; and an overall length of about 7 mm. The longitudinal length of the base portion is about 2 mm, the longitudinal length of the isolation portion is about 2 mm, and the longitudinal length of the burning portion is about 3 mm. The cross sectional shape of the base portion is rectangular, and the base portion is about 4 mm wide and about 5.6 mm high. The cross sectional shape of the isolation portion is square, and the isolation portion is about 4 mm wide and about 4 mm high. The cross sectional shape of the burning portion is square, and the burning portion is about 4 mm wide and about 4 mm high. The fuel element includes a void space having a rectangular shape, extending about 2.5 mm longitudinally and 2.2 mm across. The void space is positioned 3 mm from the foremost face of the fuel element and extends towards the base end of the fuel element. Two grooves of 0.4 mm width and 1 mm depth extend across the front face of the fuel element. The fuel element weighs about 117 mg, and has a density of about 1.8 g/cc as determined using a helium pycnometer. No longitudinally extending air passageways extend completely through either of the burning or base portions of the fuel element.

The fuel element is provided by extruding a paste of hardwood pulp carbon and sodium carboxymethylcellulose binder available as Hercules 7HFSCMC from Hercules Inc.

The hardwood pulp carbon is prepared by carbonizing a non-talc containing grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to a fine powder having an average particle size of about 4 to about 6 microns in diameter.

About 90 parts of the finely powdered hardwood carbon is admixed with about 10 parts of the sodium carboxymethylcellulose binder, and sufficient water to provide a mixture having a stiff, dough-like paste form.

Fuel elements are extruded from the paste using a ram extruder. The resulting extrudate is air dried. The extrudate then is cut into sections of 4 mm lengths, thereby providing a plurality of fuel elements.

Retaining Member For Fuel Element

A small cup is manufactured from deep drawn aluminum sheet having a thickness of about 0.004 inch. The cup has sealed sides and bottom, and has an open top. The height of the cup is about 2.9 mm. Two sides of the cup are parallel to one another such that the width of the cup is about 6.5 mm. Two sides of the cup are circular such that the maximum width of the cup is about 7.5 mm.

The fuel element is positioned in the cup so that the face of the base of fuel element rests on the inner bottom face of the cup. The face of the base of the fuel element is parallel to the extrusion axis of the fuel element (i.e., the extrusion axis of the fuel element is perpendicular to the longitudinal axis of the ultimate aerosol delivery article). The parallel sides of the cup then are crimped over portions of the front face of the respective base segments of the fuel element so as to hold the fuel element securely in place within the cup.

Heat Conductive Cartridge and Aerosol Generating Means

A cylindrical cartridge is manufactured from deep drawn aluminum sheet having a thickness of about 0.004 inch. The cartridge has a circular cross-sectional shape having an inner diameter of about 7.2 mm. One end of the cartridge is open; and the other end is sealed and an opening of about 1.5 mm diameter is punched through the bottom face of the cartridge. The cartridge has a length of about 14 mm.

Into the cartridge is placed 325 mg of aerosol forming material and substrate therefor. The substrate and aerosol forming material includes about 25 percent glycerin, about 5 percent flavor oil, and about 70 percent alpha alumina beads available as D-2 Sintered Alpha Alumina from W. R. Grace & Co. The beads have a surface area of about 4 $m^2/g$ to about 8 $m^2/g$ as determined using the BET method, and have a size from '14 to +20 mesh (U.S.).

Into the cartridge is inserted the retaining member such that the fuel element held in place by the retaining member extends about 1 mm beyond the the front of the cartridge. The retaining member is held firmly in place within the cartridge by a friction fit.

Mouthend Piece and Assembly of the Aerosol Delivery Article

A tube of about 78 mm length and about 7.7 mm diameter is made from a web of paper about 27 mm wide. The paper is a 76 lb. Mouthpiece Paper having a thickness of about 0.012 inch, and is available from Simpson Paper Co. The paper is formed into a tube by lap-joining the paper using a water-based ethylene vinyl acetate adhesive.

Into one end of the paper tube is inserted the cartridge such that the front face of the fuel element is flush with the front end of the paper tube. As a result, the extrusion axis of the fuel element is perpendicular to the longitudinal axis of the aerosol delivery article. The cartridge is held in place securely within the paper tube by friction fit.

Into the opposite end of the paper tube is inserted a cylindrical filter element. The filter element has a length of about 10 mm and a circumference of about 24 mm. The filter element is provided using known filter making techniques from cellulose acetate tow (8.0 denier per filament; 40,000 total denier) and circumscribing paper plug wrap.

The aerosol delivery article is used, and yields visible aerosol and flavor (i.e., volatilized components) on all puffs for about 10 puffs.

EXAMPLE 2

Aerosol delivery articles of the type illustrated in FIG. 1 are manufactured essentially as described in Example 1, except that the following fuel elements are employed:

A segmented fuel element has base, isolation and burning portions; and an overall length of about 7 mm. The fuel element has the shape shown generally in FIG. 11. The longitudinal length of the base portion is about 2 mm, the longitudinal length of the isolation portion is about 2 mm, and the longitudinal length of the burning portion is about 3 mm. The cross sectional shape of the base portion is rectangular, and the base portion is about 5.6 mm high and about 4 mm wide. The cross sectional outer dimensions of the isolation portion increase from the burning portion toward the base portion. The cross sectional shape of the burning portion is square, and the burning portion is about 4 mm high and about 4 mm wide. The fuel element includes a void space having a triangular shape, extending about 2.5 mm longitudinally and 2.2 mm across. The tip of the triangular void space is positioned 3 mm from the foremost face of the fuel element and extends towards the base end of the fuel element. The fuel element weighs about 109 mg, and has a density of about 1.8 g/cc as determined using a helium pycnometer. No longitudinally extending air passageways extend completely through either of the burning or base portions of the fuel element.

The fuel element is provided by extruding a paste hardwood pulp carbon and sodium carboxymethylcellulose binder available as Hercules 7HFSCMC from Hercules Inc.

The hardwood pulp carbon is prepared as described in Example 1.

About 90 parts of the finely powdered hardwood carbon is admixed with about 10 parts of the sodium carboxymethylcellulose binder, and sufficient water to provide a mixture having a stiff, dough-like paste form.

Fuel elements are extruded from the paste using a ram extruder. The resulting extrudate is air dried. The extrudate then is cut into sections of about 4 mm lengths, thereby providing a plurality of fuel elements.

The article is used and yields visible aerosol and flavor on all puffs for about 13 puffs. The article exhibits a pressure drop of about 65 mm $H_2O$ at 17.5 cc/sec air flow rate as measured using a Filtrona Filter Test Station (CTS Series) available from Filtrona Instruments and Automation Ltd.

EXAMPLE 3

Aerosol delivery articles are manufactured as described in Example 2, except that the following substrate materials and aerosol forming material are employed:

The cartridge contains two segments of substrate materials. One segment, positioned immediately behind the retaining member, consists of about 140 mg alumina beads and aerosol forming material described in Example 1. A second segment, positioned behind the alumina beads, consists of glycerin carried by a gathered paper wrapped in a paper wrapper. The gathered paper substrate has a generally cylindrical shape, about 3.3 mm in length and about 23.2 mm in circumference. The longitudinal axis of the cylindrical paper substrate is positioned parallel to the longitudinal axis of the article. The gathered paper is available as MS2408/S538 from Filtrona Ltd , and is gathered into a segment weighing about 25 mg. About 45 mg of glycerin is added to the gathered paper.

The article is used, and yields visible aerosol and flavor on all puffs for about 13 puffs. The article exhibits a pressure drop of about 90 mm $H_2O$ at 17.5 cc/sec using the device described in Example 2.

EXAMPLE 4

Aerosol delivery articles are manufactured as described in Example 2, except that the following substrate material and aerosol forming material are employed.

The cartridge contains a segment of substrate material which is positioned immediately behind the retaining member. The segment consists of glycerin and flavor carried by a gathered paper wrapper in a paper wrapper. The gathered paper substrate has a generally cylindrical shape, about 7 mm in length and about 23 mm in circumference. The longitudinal axis of the cylindrical paper substrate is positioned parallel to the longitudinal axis of the article. The gathered paper is available as MS2408/S538 from Filtrona Ltd., and is gathered into segment weighing about 53 mg. About 130 mg glycerin and about 8 mg flavor is added to the paper. The flavor is Natural and Artificial Coffee Flavor, No. S2329, from Petran Products Corp.

The article is used, and yields visible aerosol and coffee flavor on all puffs for about 10 puffs.

What is claimed is:

1. An aerosol delivery article comprising:

(a) a longitudinally segmented combustible fuel element having a burning segment, and a base segment, and an isolation segment positioned between the burning and base segments, the isolation segment having a cross sectional area less than that of the base segment;

(b) aerosol generating means physically separate from the fuel element;

(c) an enclosure member radially spaced from the longitudinal outer periphery of the burning segment of the fuel element; and (d) retaining means contacting the base segment of the fuel element and securing the fuel element in position within the article.

2. The article of claim 1 wherein the fuel element is longitudinally disposed from the aerosol generating means.

3. The article of claim 1 or 2 wherein the fuel element has a total length, prior to burning, of less than about 20 mm.

4. The article of claim 3 wherein the fuel element has a density of at least about 0.5 g/cc.

5. The article of claim 1 or 2 wherein the fuel element is carbonaceous.

6. The article of claim 3 wherein the fuel element is carbonaceous.

7. The article of claim 1 or 2 wherein the fuel element contains greater than about 75 weight percent carbon.

8. The article of claim 1 or 2 wherein the base segment of the fuel element has a generally rectangular transverse cross section.

9. The article of claim 1 or 2 wherein the fuel element has a transverse cross section such that two opposite sides thereof are essentially parallel to one another.

10. The article of claim 1 or 2 wherein the fuel element includes at least one transversely extending void space.

11. The article of claim 2 wherein the length of the burning segment ranges from about 4 mm to about 15 mm prior to burning, the length of the base segment ranges from about 1 mm to about 3 mm, and the length of the isolation segment is up to about 5 mm.

12. The article of claim 1 wherein the aerosol generating means includes a substrate carrying an aerosol forming material.

13. The article of claim 12 wherein the aerosol forming material includes a polyhydric alcohol.

14. The article of claim 12 wherein the aerosol forming material includes a drug, and the drug is carried by the substrate.

15. The article of claim 12 wherein the aerosol forming material includes a flavor, and the flavor is carried by the substrate.

16. The article of claim 12 including an airflow passage between the longitudinal outer periphery of the burning segment of the fuel element and the enclosure member.

17. The article of claim 1 wherein a portion of the retaining means contacts the enclosure member.

18. The article of claim 17 including at least one airflow passage between the enclosure member and retaining means.

19. The article of claim 1 or 18 including an airflow passage between the longitudinal periphery of the burning portion of the fuel element and the enclosure member.

20. The article of claim 1 wherein the enclosure member is composed of a heat conductive material.

21. The article of claim 20 wherein the enclosure member contacts at least a portion of the aerosol generating means.

22. The article of claim 1 having an extreme lighting end and an extreme mouth end, the enclosure member being open at the extreme lighting end of the article to expose complete the lighting end of the fuel element.

23. The article of claim 1 wherein the retaining means provides an air impermeable barrier between the back face of the fuel element and the aerosol generating means.

24. The article of claim 1 including a mouthend piece having a generally tubular shape.

25. The article of claim 1 wherein the cross sectional circumference of the base segment of the fuel element is greater than that of the burning segment of the fuel element.

26. The article of claim 1 wherein the base segment of the fuel element has a cross sectional area of about 15 $mm^2$ to about 30 $mm^2$, and the isolation segment has a cross sectional area of about 5 $mm^2$ to about 10 $mm^2$.

27. An aerosol delivery article having a longitudinal axis comprising:

(a) an extruded fuel element having an extrusion axis, the fuel element being positioned within the article such that the extrusion axis of the fuel element is perpendicular to the longitudinal axis of the article;

(b) aerosol generating means physically separate from the fuel element; and (c) retaining means for securing the fuel element in position within the article.

28. The article of claim 27 wherein the extruded fuel element is a longitudinally segmented combustible fuel element having a burning segment and a base segment.

29. The article of claim 27 or 28 having an extreme lighting end, the enclosure member being open at the extreme lighting end of the article to expose completely the lighting end of the fuel element.

30. The article of claim 28 wherein the fuel element further includes an isolation segment positioned between the burning and base segments.

31. The article of claim 28 wherein the retaining means contacts the base segment of the fuel element 32. The article of claim 31 including an enclosure member radially spaced from the longitudinal outer periphery of the burning segment of the fuel element.

33. The article of claim 28 including an enclosure member radially spaced from the longitudinal outer periphery of the burning segment of the fuel element.

34. The article of claim 27, 28 or 30 wherein the fuel element has a total length, prior to burning, of less than about 20 mm.

35. The article of claim 27 including a mouthend piece having a generally tubular shape.

36. The article of claim 27 wherein the retaining means provides an air impermeable barrier between the back face of the fuel element and the aerosol generating means.

37. The article of claim 27, 28 or 30 wherein the fuel element includes at least one void space extending therethrough in a direction transverse to the longitudinal axis of the article.

38. The article of claim 27, 28 or 30 wherein the fuel element has a transverse cross section such that two opposite sides thereof are essentially parallel to one another.

39. The article of claim 30 wherein the length of the burning segment ranges from about 4 mm to about 15 mm prior to burning, the length of the base segment ranges from about 1 mm to about 3 mm, and the length of the isolation segment is up to about 5 mm.

40. The article of claim 27 wherein the aerosol generating means includes a substrate carrying an aerosol forming material.

41. The article of claim 40 wherein the aerosol forming material includes a polyhydric alcohol.

42. The article of claim 40 wherein the aerosol forming material includes a drug, and the drug is carried by the substrate.

43. The article of claim 40 wherein the aerosol forming material includes a flavor, and the flavor is carried by the substrate.

44. The article of claim 33 including an airflow passage between the longitudinal outer periphery of the burning segment of the fuel element and the enclosure member.

45. The article of claim 27, 28 or 30 wherein the fuel element has a density of at least about 0.5 g/cc.

46. The article of claim 27, 28 or 30 wherein the fuel element is carbonaceous.

47. The article of claim 45 wherein the fuel element is carbonaceous.

48. The article of claim 27, 28 or 30 wherein the fuel element contains greater than about 75 weight percent carbon.

49. The article of claim 33 or 32 wherein the enclosure member is composed of a heat conductive material.

50. The article of claim 28 or 30 wherein the base segment of the fuel element has a generally rectangular transverse cross section.

51. The article of claim 31 wherein a portion of the retaining means contacts the enclosure member.

52. The article of claim 51 including at least one airflow passage between the enclosure member and retaining means.

53. The article of claim 52 including an airflow passage between the longitudinal outer periphery of the burning portion of the fuel element and the enclosure member.

54. The article of claim 49 wherein the enclosure member contacts at least a portion of the aerosol generating means.

55. The article of claim 27, 28, 30, 31 or 33 wherein the aerosol generating means is longitudinally disposed from the fuel element.

56. The article of claim 34 wherein the aerosol generating means is longitudinally disposed from the fuel element.

57. The article of claim 30 wherein the cross sectional periphery of the base segment of the fuel element is greater than the cross sectional periphery of the isolation segment of the fuel element.

58. The article of claim 30 wherein the base segment of the fuel element has a cross sectional area of about 15 $mm^2$ to about 30 $mm^2$, and the isolation segment has cross sectional area of about 5 $mm^2$ to about 10 $mm^2$.

59. The article of claim 30 wherein the burning segment of the fuel element has a cross sectional area of about 10 $mm^2$ to about 25 $mm^2$, and the isolation segment has a cross sectional area of about 5 $mm^2$ to about 10 $mm^2$.

60. An aerosol delivery article comprising:

(a) a longitudinally segmented combustible fuel element having a burning segment, a base segment, and an isolation segment positioned between the burning and base segments, the isolation segment having a cross sectional area less than that of the base segment;

(b) aerosol generating means physically separate from the fuel element; and (c) retaining means contacting the base segment of the fuel element and securing the fuel element in position within the article.

61. The article of claim 60 wherein the fuel element has a total length, prior to burning, of less than about 20 mm.

62. The article of claim 60 or 61 wherein the fuel element has a density of at least about 0.5 g/cc.

63. The article of claim 60 wherein the aerosol generating means is longitudinally disposed from the fuel element.

64. The article of claim 60 wherein the fuel element includes at least one transversely extending void space.

65. The article of claim 60 wherein the length of the burning segment ranges from about 4 mm to about 15 mm prior to burning, the length of the base segment ranges from about 1 mm to about 3 mm, and the length of the isolation segment is up to about 5 mm.

66. The article of claim 60 wherein the aerosol generating means includes a substrate carrying an aerosol forming material.

67. The article of claim 60 or 61 wherein the burning and base segments each do not have any longitudinally extending air passageways extending entirely therethrough.

68. The article of claim 60 wherein the cross sectional periphery of the base segment of the fuel element is greater than the cross sectional periphery of the isolation segment of the fuel element.

69. The article of claim 60 wherein the retaining means provides an air impermeable barrier between the back face of the fuel element and the aerosol generating means.

70. The article of claim 60 including a mouthed piece having a generally tubular shape.

71. The article of claim 60 wherein the base segment of the fuel element has a cross sectional area of about 15

$mm^2$ to about 30 $mm^2$, and the isolation segment has a cross sectional area of about 5 $mm^2$ to about 10 $mm^2$.

72. The article of claim 60 wherein the burning segment of the fuel element has a cross sectional area of about 10 $mm^2$ to about 25 $mm^2$, and the isolation segment has a cross sectional area of about 5 $mm^2$ to about 10 $mm^2$.

73. An aerosol delivery article comprising:

(a) a longitudinally segmented combustible fuel element having a burning segment and a base segment, the burning segment being different in composition from the base segment;

(b) aerosol generating means physically separate from the fuel element; and (c) retaining means contacting the base segment of the fuel element and securing the fuel element in position within the article.

74. The article of claim 73 wherein the fuel element has a total length, prior to burning, of less than about 20 mm.

75. The article of claim 73 wherein the aerosol generating means is longitudinally disposed from the fuel element.

76. An aerosol delivery article comprising:

(a) a longitudinally segmented combustible fuel element having a burning segment, and a base segment, and an isolation segment positioned between the burning and base segments, the isolation segment having a cross sectional area less than that of the burning segment;

(b) aerosol generating means physically separate from the fuel element;

(c) an enclosure member radially spaced from the longitudinal outer periphery of the burning segment of the fuel element; and (d) retaining means contacting the base segment of the fuel element and securing the fuel element in position within the article.

77. The article of claim 76 wherein the fuel element is longitudinally disposed from the aerosol generating means.

78. The article of claim 76 or 77 wherein the fuel element has a total length, prior to burning, of less than about 20 mm.

79. The article of claim 76 wherein the fuel element is carbonaceous.

80. The article of claim 76 wherein the length of the burning segment ranges from about 4 mm to about 15 mm prior to burning, the length of the base segment ranges from about 1 mm to about 3 mm, and the length of the isolation segment is up to about 5 mm.

81. An aerosol delivery article comprising:

(a) a longitudinally segmented combustible fuel element having a burning segment, a base segment, and an isolation segment positioned between the burning and base segments, the isolation segment having a cross sectional area less than that of the burning segment;

(b) aerosol generating means physically separate from the fuel element; and (c) retaining means contacting the base segment of the fuel element and securing the fuel element in position within the article.

82. The article of claim 81 wherein the fuel element has a total length, prior to burning, of less than about 20 mm.

83. The article of claim 81 or 82 wherein the fuel element has a density of at least about 0.5 g/cc.

84. The article of claim 81 wherein the aerosol generating means is longitudinally disposed from the fuel element.

85. The article of claim 81 wherein the fuel element includes at least one transversely extending void space.

86. The article of claim 82 wherein the burning segment of the fuel element has a cross sectional area of about 10 $mm^2$, to about 25 $mm^2$, and the isolation segment has a cross sectional area of about 5 $mm^2$ to about 10 $mm^2$.

87. An aerosol delivery article comprising:

(a) a longitudinally segmented combustible fuel element having a burning segment, a base segment, and an isolation segment positioned between the burning and base segments, the isolation segment having a cross-sectional area less than that of the base segment; and (b) aerosol generating means physically separate from the fuel element.

88. The article of claim 87 wherein the fuel element has a total length, prior to burning, of less than about 20 mm.

89. The article of claim 87 or 88 wherein the fuel element has a density of at least about 0.5 g/cc.

90. The article of claim 87 wherein the aerosol generating means is longitudinally disposed from the fuel element.

91. The article of claim 87 or 88 wherein the fuel element is carbonaceous.

92. The article of claim 87 wherein the fuel element is circumscribed by an air permeable insulating member which assists in holding he fuel element in place.

93. The article of claim 87 or 92 wherein the aerosol generating means includes a substrate carrying an aerosol forming material.

94. The article of claim 93 wherein the substrate is a non-woven sheet-like material.

95. The article of claim 93 wherein the substrate is gathered paper.

96. The article of claim 93 wherein the aerosol forming material includes a polyhydric alcohol and a flavor.

97. The article of claim 87, 88 or 90 wherein the burning segment of the fuel element includes grooves extending along the outer longitudinal periphery thereof.

98. The article of claim 87, 88 or 90 wherein the burning and base segments of the fuel element do not have any longitudinally extending air passageways extending entirely therethrough.

* * * * *